US005699899A

United States Patent [19]

Kahlbau

[11] Patent Number: 5,699,899

[45] Date of Patent: Dec. 23, 1997

[54] ELECTROMECHANICAL COMPONENT, IN PARTICULAR A RELAY, HAVING A SEALED CASING

[75] Inventor: Lutz Kahlbau, Berlin, Germany

[73] Assignee: Siemens Aktiengesellschaft, Munich, Germany

[21] Appl. No.: 602,811

[22] PCT Filed: Nov. 2, 1994

[86] PCT No.: PCT/DE94/01289

§ 371 Date: Feb. 26, 1996

§ 102(e) Date: Feb. 26, 1996

[87] PCT Pub. No.: WO95/12890

PCT Pub. Date: May 11, 1995

[30] Foreign Application Priority Data

Nov. 3, 1993 [DE] Germany ..... 43 37 505.7

[51] Int. Cl.[6] ..... H01H 9/04

[52] U.S. Cl. ..... 200/302.1; 200/303

[58] Field of Search ..... 200/302.1, 303, 200/292; 29/622

[56] References Cited

U.S. PATENT DOCUMENTS

| | | | |
|---|---|---|---|
| 3,323,199 | 6/1967 | Prival | 29/622 |
| 4,622,739 | 11/1986 | Pejouhy et al. | 29/622 |
| 4,780,578 | 10/1988 | Heskel | 200/302.1 |
| 4,975,545 | 12/1990 | Ching et al. | 200/302.1 |

FOREIGN PATENT DOCUMENTS

| | | |
|---|---|---|
| 0 564 876 A1 | 10/1993 | European Pat. Off. . |
| 2 320 617 | 11/1974 | Germany . |
| 25 56 610 A1 | 6/1977 | Germany . |
| 26 17 633 A1 | 11/1977 | Germany . |
| 32 08 299 A1 | 10/1982 | Germany . |
| 33 19 329 A1 | 1/1985 | Germany . |
| 34 28 595 C2 | 2/1986 | Germany . |
| 36 40 721 C1 | 6/1988 | Germany . |
| 40 15 115 A1 | 11/1991 | Germany . |

*Primary Examiner*—David J. Walczak
*Attorney, Agent, or Firm*—Hill, Steadman & Simpson

[57] ABSTRACT

The component has a casing base (1) which is coated with an elastomer layer (6; 9) in the region of apertures (4) and of an edge gap (15) between the casing base (11) and the cap (2). A good seal is thus produced, without any additional operations, when connecting elements (11) are pressed in or when the cap (2) is pressed on. The base can be produced from two plastics having different properties, using the two-component injection-molding method.

5 Claims, 2 Drawing Sheets

ELECTROMECHANICAL COMPONENT, IN PARTICULAR A RELAY, HAVING A SEALED CASING

BACKGROUND OF THE INVENTION

The invention relates to an electromechanical component, in particular a relay, having a casing which is formed from a base and a cap, the base, which is composed of plastic, having apertures in which connecting elements are anchored and sealed by insertion.

Various methods are already used in order to seal an electromechanical component, for example a relay according to German reference DE 34 28 595 C2, in a plastic casing against moisture and other environmental influences, in order on the one hand to bond or to weld the cap to the base in the edge region and, on the other hand, to seal the bushings of the connecting elements using a potting compound. These conventional methods are, however, relatively complex and uneconomic.

German reference DE 26 17 633 A1 discloses an arrangement for an electromechanical component of the type mentioned initially, in the case of which the openings in the base of the component are provided with sealing lips which are molded onto the base and are intended to be closely joined to the connecting pins. However, since these sealing lips are formed from the same material as the base, success of the sealing is doubtful. This is because either the base material is soft, so that the base cannot give the contact elements sufficient robustness in the interior of the casing, or the plastic is dimensionally stable, which in turn has the disadvantage that the sealing lips formed from the same material are not closely joined to the connecting elements in a soft enough manner to produce reliable sealing. In addition, such sealing lips intrinsically on their own produce only a more or less linear seal which, particularly in the case of connecting elements having a rectangular cross section, for example flat plugs, do not allow reliable sealing.

On the other hand, sealing lips in the edge gap between the base body and the cap have already been proposed in German reference DE-OS 23 20 617; however, this relates only to a preliminary seal which is intended to prevent the potting compound, which is to be inserted later, from running into the casing.

DE 33 19 329 A1 discloses a relay having a washproof base plate in which potting compound is inserted in the intermediate space between the slots of the base plate and the inserted connecting pins. This is associated with the disadvantage mentioned initially, that the additional potting compound must be distributed, and subsequently cured, using complex operations.

Finally, DE 25 56 610 B2 discloses a base body, which is composed of insulating material, for relays which can be hermetically sealed, a base body composed of thermosetting plastic having a jacket of thermoplastic material extrusion coated onto it. The connecting elements are in this case actually embedded in the thermosetting plastic base body, which, just on its own, requires a complex production process. In this case, an additional operation, by means of which the parts are intended to be bonded or welded, is proposed for sealing between the thermoplastic jacket and the cap.

SUMMARY OF THE INVENTION

The aim of the present invention is to design a component of the type mentioned initially, such that a seal of the casing gaps and bushings, particularly to the connecting elements which are secured by insertion, is achieved in a very simple and economic manner.

This aim is achieved according to the invention in that the base, which is composed of a dimensionally stable plastic, is coated, at least in the wall regions of the apertures, with a layer of a thermoplastic elastomer, and in that the connecting elements have a cross section, which is larger than the remaining width of the respective aperture, in such a manner that said connecting elements are anchored in a sealed manner by the insertion, with a press fit.

Thus, in the case of the invention, two plastic materials having different properties are used at least for the base body or base which supports the connecting parts. The plastic having the higher strength, for example a mineral-reinforced or glass-fibre-reinforced thermoplastic such as polyamide, provides the dimensional stability, while the second material, namely a thermoplastic elastomer, such as polyurethane for example, carries out the sealing function. In principle, the dimensionally stable plastic could admittedly also be a thermosetting plastic, but, because of the more economic processing, it is more favorable if two thermoplastics having different properties are used since, then, both materials can be formed successively on one and the same machine using the two-component injection-molding method. Thus, since the sealing function is integrated just by the production of the base body or base using two plastic components, no additional assembly or sealing outlay is required after the parts have been plugged together. The tolerance of the joined parts is compensated for by the elastomer, so that a press fit is always ensured.

In contrast to the doubtful sealing provided by thin sealing lips, the cladding according to the invention of the bushings for the connecting elements produces a large-area seal over the entire bushing length. The seal is particularly advantageous and reliable if the elastomer layer in each case surrounds both edges of the base apertures like a sleeve. In addition, it can be advantageous if the elastomer layer forms an additional, circumferential sealing lip on the outside of the casing in the region of the edge of the respective base aperture.

As a rule, the boundary surfaces of the two plastic components are connected to one another to a greater or lesser extent. Since the sealing is produced via a press fit, this is, however, not absolutely essential. Two incompatible plastics can therefore be used which do not bond to one another during forming; this is particularly true if the elastomer is connected in a positively locking manner to the base or base body, for example in the manner of the said sleeve.

An advantageous refinement furthermore provides that the base or the cap is likewise provided with a layer of the elastomer in each case in the region of an edge gap between the base and the cap. In principle, the cap can also be composed of metal, the sealing function between the plastic and metal then acting in the same way as to the metallic connecting elements. However, the cap will also as a rule be composed of plastic, so that the second component, which is formed from elastomer, for sealing the edge gap can optionally be fitted to the base or to the cap. The seal becomes particularly reliable if the base forms a circumferential sealing edge which is coated with an elastomer layer having a U-shaped profile and engages in a circumferential groove in the cap. It is, of course, also possible to implement a reverse design of the parts, with the same effect. Furthermore, the elastomer layer can form one or more circumferential sealing ribs which project into the edge gap.

In principle, the elastomer coating need be provided only in the region of the points to be sealed, so that the elastomer need be injected in the form of islands just at these points. However, it can be advantageous to connect a plurality of these points to one another via webs in order to reduce the number of injections in the injection-molding tool.

These connections can be produced in the form of webs which are either located in recessed channels in the base or can run as raised webs on its surface.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 5:
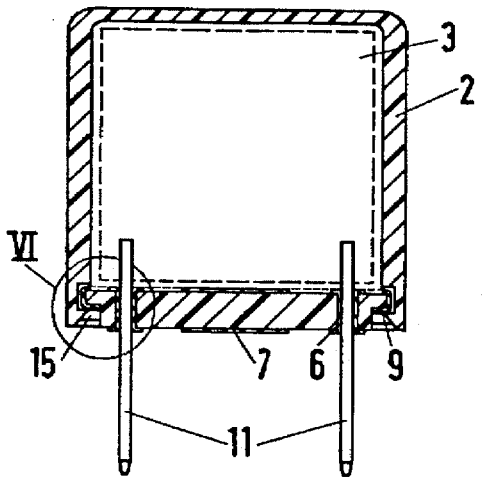
FIG. 5 shows a section V—V from FIG. 4.

The Figures show a relay base 1 which, together with a cap 2, forms a casing which accommodates a relay system 3, which is also indicated schematically in FIG. 5. This relay system 3 can be formed, for example, according to German reference DE 34 28 595 C2.

Figure 1:
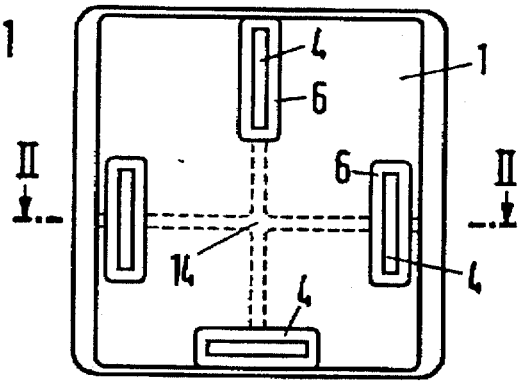
FIG. 1 shows a relay base in a view from underneath.
Figure 2:
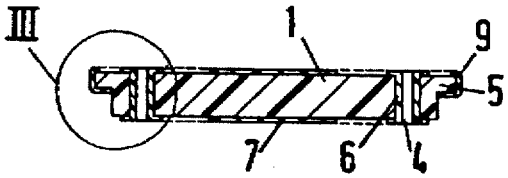
FIG. 2 shows a section II—II of the base in FIG. 1.
Figure 3:
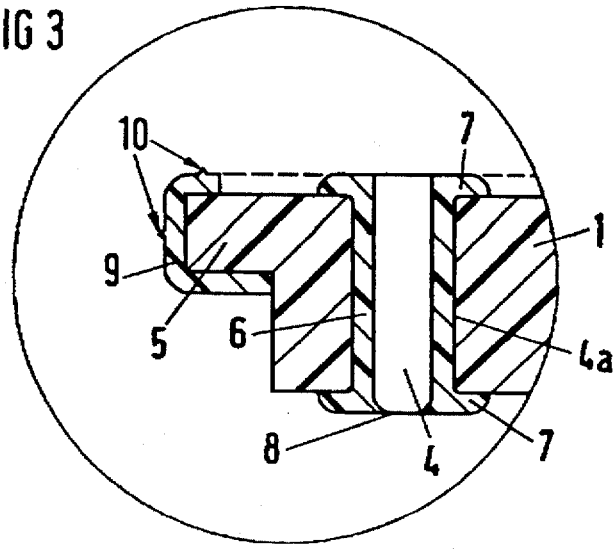
FIG. 3 shows an enlarged detail III from FIG. 2.

The base which is shown just in FIGS. 1 to 3 has apertures 4 for connecting pins 11 (see FIG. 5), which in the present case are designed as flat connectors. The bushings are, accordingly, rectangular. In addition, the base has a stepped, circumferential sealing edge 5. The base itself is composed of dimensionally stable plastic, for example a glass-fibre reinforced polyamide.

As can be seen in the enlargement in FIG. 3, the inner walls 4*a* of the apertures 4 are each coated with a layer 6 composed of an elastomer; polyurethane or a thermoplastic having similar properties can be used as the material. At each of its ends, the elastomer layer 6 has a broadened edge 7 in the form of a sleeve which in each case engages over the edge of the aperture 4. In addition, the elastomer layer forms a circumferential sealing lip 8 at the end of the aperture 4 pointing towards the outside of the casing.

The sealing edge 5 of the base 1 is likewise coated with an elastomer layer 9, whose U-shaped profile engages around the edge 5 on three sides. In addition, two circumferential sealing ribs 10 are formed on this elastomer layer 9.

Figure 4:
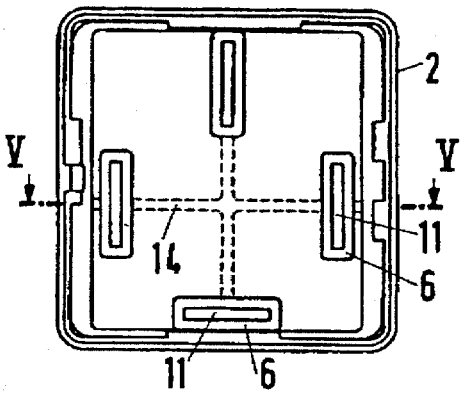
FIG. 4 shows a relay with a base according to FIG. 1, which is fitted with connecting elements and is provided with a cap.
Figure 6:
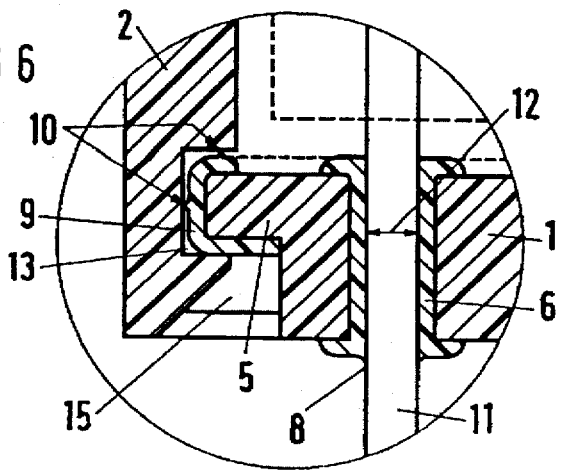
FIG. 6 shows an enlarged detail VI from FIG. 5.

FIGS. 4 to 6 show the same views as FIGS. 1 to 3, but now with a completely assembled relay, that is to say with the cap 2 fitted and the relay system 3 inserted. In this case, the connecting pins 11 are pressed into the apertures 4, penetrating the elastomer layer 6 as a result of the cross section or the width 12 of the connecting pins 11 being oversized, leading to a press fit and to corresponding sealing of the connecting pins 11. As FIG. 6 shows, the sealing lips 8 which are formed on the outside are closely joined to the connecting pins 11. When the cap 2 is snapped on, the sealing edge 5 engages in a circumferential groove 13 and in this case likewise forms a press fit for sealing the circumferential edge gap 15. The seal is in consequence improved by the sealing ribs 10, which act in two mutually perpendicular directions.

FIGS. 1 and 4 also show connecting webs 14 which are produced by flow channels in the injection-molding tool. There are therefore elastomer webs which connect the various elastomer layers 6 and 9 in the form of recessed or raised webs, so that the number of injections in the injection-molding tool can be reduced. These connecting webs 14 can run on the inside of the casing and/or on the outside of the casing of the base 1. The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed:

1. An electromechanical component, comprising:

a casing which is formed from a base and a cap, the base having apertures in which connecting elements are anchored and sealed by insertion;

the base, which is composed of a dimensionally stable plastic, being coated, at least in wall regions of the apertures, with a layer of a thermoplastic elastomer;

the connecting elements having a cross section, which is larger than a remaining width of respective apertures such that said connecting elements are anchored in a sealed manner by insertion of a respective connecting element into a respective aperture with a press fit;

one of the base and the cap being provided with a layer of elastomer in a region of an edge gap between the base and the cap;

the base forming a circumferential sealing edge which is coated with an elastomer layer having a U-shaped profile and which engages in a circumferential groove in the cap.

2. An electromechanical component, comprising:

a casing which is formed from a base and a cap, the base having apertures in which connecting elements are anchored and sealed by insertion;

the base, which is composed of a dimensionally stable plastic, being coated, at least in wall regions of the apertures, with a layer of a thermoplastic elastomer;

the connecting elements having a cross section, which is larger than a remaining width of respective apertures such that said connecting elements are anchored in a sealed manner by insertion of a respective connecting element into a respective aperture with a press fit;

the base forming a circumferential sealing edge which is coated with an elastomer layer;

the elastomer coatings of a plurality of apertures and on the sealing edge being connected to one another via connecting webs composed of the elastomer material.

3. An electromechanical component, comprising:

a casing which is formed from a base and a cap, the base having apertures in which connecting elements are anchored and sealed by insertion;

the base, which is composed of a dimensionally stable plastic, being coated, at least in wall regions of the apertures, with a layer of a thermoplastic elastomer;

the connecting elements having a cross section, which is larger than a remaining width of respective apertures such that said connecting elements are anchored in a sealed manner by insertion of a respective connecting element into a respective aperture with a press fit;

the cap having a circumferential sealing edge which is coated with an elastomer layer having a U-shaped profile and which engages in a circumferential groove in the base.

4. A relay, comprising:

a relay system having connecting elements;

a casing which is formed from a base and a cap, the base having apertures in which the connecting elements are anchored and sealed by insertion;

the base being coated, at least in wall regions of the apertures, with a layer of a thermoplastic elastomer;

the connecting elements being a cross section, which is larger than a width of a respective aperture less a thickness of the thermoplastic elastomer in the respective aperture, such that said connecting elements are anchored in a sealed manner by the insertion of a respective connecting element into a respective aperture with a press fit;

one of the base and the cap having a layer of the elastomer in a region of an edge gap between the base and the cap, the base forming a circumferential sealing edge which is coated with an elastomer layer having a U-shaped profile and which engages in a circumferential groove in the cap.

5. A relay, comprising:

a relay system having connecting elements;

a casing which is formed from a base and a cap, the base having apertures in which the connecting elements are anchored and sealed by insertion;

the base being coated, at least in wall regions of the apertures, with a layer of a thermoplastic elastomer;

the connecting elements being a cross section, which is larger than a width of a respective aperture less a thickness of the thermoplastic elastomer in the respective aperture, such that said connecting elements are anchored in a sealed manner by the insertion of a respective connecting element into a respective aperture with a press fit;

the base forming a circumferential sealing edge which is coated with an elastomer layer having a U-shaped profile and engages in a circumferential groove in the cap;

the elastomer coatings of one of a plurality of apertures and the sealing edge being connected to one another via connecting webs composed of the elastomer material.

* * * * *